US009593443B2

(12) United States Patent
Krieger et al.

(10) Patent No.: US 9,593,443 B2
(45) Date of Patent: Mar. 14, 2017

(54) COMPOSITIONS AND METHODS FOR EMBOSSING AND DEBOSSING FABRICS

(71) Applicant: Crayola LLC, Easton, PA (US)

(72) Inventors: Cheryl Krieger, Bangor, PA (US); Veronica A. Pinto, Bangor, PA (US)

(73) Assignee: Crayola LLC, Easton, PA (US)

( * ) Notice: Subject to any disclaimer, the term of this patent is extended or adjusted under 35 U.S.C. 154(b) by 498 days.

(21) Appl. No.: 14/089,449

(22) Filed: Nov. 25, 2013

(65) Prior Publication Data

US 2014/0144795 A1 May 29, 2014

Related U.S. Application Data

(60) Provisional application No. 61/730,714, filed on Nov. 28, 2012.

(51) Int. Cl.

| | |
|---|---|
| ***D06Q 1/08*** | (2006.01) |
| ***D06Q 1/06*** | (2006.01) |
| ***B41M 7/00*** | (2006.01) |
| ***D06M 15/333*** | (2006.01) |
| ***D06M 23/14*** | (2006.01) |

(52) U.S. Cl.
CPC ..... *D06M 15/333* (2013.01); *D06M 23/14* (2013.01); *D06Q 1/08* (2013.01)

(58) Field of Classification Search
CPC .. D06Q 1/08; D06Q 1/06; B41M 7/00; D06C 23/04
USPC ..... 8/114, 115; 427/288
See application file for complete search history.

(56) References Cited

U.S. PATENT DOCUMENTS

| | | | | |
|---|---|---|---|---|
| 2,315,002 A * | 3/1943 | Lyem | D06Q 1/02 | 8/115 |
| 2,406,718 A | 8/1946 | Thomas | | |
| 2,838,416 A | 6/1958 | Babiarz | | |
| 2,926,414 A * | 3/1960 | Weiss | D06Q 1/08 | 26/69 R |
| 2,990,235 A * | 6/1961 | Nomura | D06M 11/05 | 264/185 |
| 3,122,444 A * | 2/1964 | Williams | D06N 7/0086 | 118/44 |
| 3,365,353 A | 1/1968 | Witman | | |
| 3,373,072 A | 3/1968 | Jones | | |
| 3,480,466 A | 11/1969 | Benson | | |
| 3,505,000 A * | 4/1970 | Shinmura | D06P 1/6495 | 525/61 |

(Continued)

FOREIGN PATENT DOCUMENTS

| | | |
|---|---|---|
| CA | 1047902 A1 | 2/1979 |
| CA | 1061516 A | 9/1979 |

(Continued)

*Primary Examiner* — Cachet Sellman
(74) *Attorney, Agent, or Firm* — RatnerPrestia

(57) ABSTRACT

The present invention provides methods for chemically embossing and debossing fabric. A composition comprising polyvinyl alcohol is applied to fabric in the shape of a design, and the fabric is dried. Upon the fabric drying, the surface of the fabric is embossed and/or debossed in the shape of the design. In particular embodiments, the composition comprises polyvinyl alcohol that is at least about 90% hydrolyzed. A kit for embossing and/or debossing fabric includes a composition comprising polyvinyl alcohol inside of a container, and one or more applicators.

38 Claims, 1 Drawing Sheet

(56) References Cited

U.S. PATENT DOCUMENTS

| | | | | | |
|---|---|---|---|---|---|
| 3,707,346 | A | * | 12/1972 | Casa | B41M 5/035 8/469 |
| 3,849,158 | A | | 11/1974 | Palmer | |
| 3,849,159 | A | | 11/1974 | Palmer | |
| 3,953,164 | A | | 4/1976 | Boba | |
| 3,956,530 | A | | 5/1976 | McKee, Jr. | |
| 3,958,054 | A | | 5/1976 | McKee, Jr. | |
| 4,082,876 | A | | 4/1978 | Miura | |
| 4,083,907 | A | * | 4/1978 | Hamilton | C09D 11/03 106/31.43 |
| 4,255,231 | A | | 3/1981 | Boba | |
| 4,340,381 | A | * | 7/1982 | Ehrenfeld, Jr. | D06Q 1/06 8/114.5 |
| 4,355,063 | A | | 10/1982 | Palmer | |
| 4,466,860 | A | | 8/1984 | Aggio | |
| 4,474,920 | A | | 10/1984 | Kyminas | |
| 4,500,319 | A | | 2/1985 | Ehrenfeld, Jr. | |
| 4,863,782 | A | | 9/1989 | Wang | |
| 5,645,751 | A | * | 7/1997 | Haley | D06M 7/00 252/8.83 |
| 5,712,018 | A | | 1/1998 | Frisch | |
| 6,649,248 | B1 | | 11/2003 | Schneider | |
| 6,855,743 | B1 | * | 2/2005 | Gvozdic | C08J 3/075 264/41 |
| 7,378,143 | B2 | | 5/2008 | Schneider | |
| 7,419,716 | B2 | | 9/2008 | Tian | |
| 7,435,264 | B2 | | 10/2008 | Kiff | |
| 7,654,580 | B2 | | 2/2010 | Alasia | |
| 2002/0127372 | A1 | | 9/2002 | Waite | |
| 2002/0162464 | A1 | * | 11/2002 | Davis | B44B 5/0057 101/3.1 |
| 2005/0214511 | A1 | | 9/2005 | Vogt | |
| 2006/0085921 | A1 | | 4/2006 | Chen | |

FOREIGN PATENT DOCUMENTS

| | | | |
|---|---|---|---|
| CA | 1255055 | A1 | 6/1989 |
| EP | 1652995 | A1 | 5/2006 |
| GB | 1255156 | A | 12/1971 |
| IT | 1232839 | B | 3/1992 |
| KR | 2006110059 | A | 10/2006 |
| WO | WO 9939042 | A1 | 8/1999 |
| WO | WO 2005057487 | A2 | 6/2005 |

* cited by examiner

COMPOSITIONS AND METHODS FOR EMBOSSING AND DEBOSSING FABRICS

CROSS-REFERENCE TO RELATED APPLICATIONS

This application claims priority to U.S. Application No. 61/730,714, filed Nov. 28, 2012, which is incorporated by reference herein, in its entirety and for all purposes.

FIELD OF THE INVENTION

The present invention relates generally to compositions and methods for embossing and debossing fabrics. More specifically, the present invention relates to compositions and methods for chemically embossing and debossing fabrics by applying polyvinyl alcohol.

BACKGROUND OF THE INVENTION

There are numerous kits and procedures available for mechanically embossing or debossing fabrics. Embossed fabrics contain a raised relief design, while debossed fabrics have a depressed design. These methods typically involve the application of heat and pressure to a fabric that is placed over a suitably-shaped mold, in order to form an emboss or deboss in the shape of the mold. However, there remains a need for chemical compositions and methods that provide an embossed or debossed effect to fabric, so that the effect can be achieved without the use of a mold.

SUMMARY OF THE INVENTION

An embodiment of the present invention provides a method for embossing and/or debossing a fabric comprising applying a composition comprising polyvinyl alcohol to a surface of the fabric in the shape of a design, and drying the fabric. Upon the fabric drying, the surface of the fabric is embossed and/or debossed in the shape of the design. In exemplary embodiments, the composition comprises polyvinyl alcohol that is at least about 90% hydrolyzed.

Another embodiment of the present invention provides a kit for use in embossing and/or debossing fabric. The kit comprises a composition comprising polyvinyl alcohol inside of a container, and one or more applicators. The kit preferably comprises instructions for use of the composition to emboss and/or deboss fabric. In particular embodiments, the one or more applicators are selected from the group consisting of squeeze bottles, brushes, markers, spatulas, and combinations thereof.

BRIEF DESCRIPTION OF THE DRAWINGS

The invention may be further understood by reference to the drawings in which.

DETAILED DESCRIPTION OF THE INVENTION

The applicants have discovered new methods for chemically embossing and debossing fabric. An embodiment of the present invention provides a method for embossing and/or debossing a fabric comprising or consisting of applying a composition comprising polyvinyl alcohol to a surface of the fabric in the shape of a design; and drying the fabric. Stated another way, an embodiment of the present invention provides a method for providing an artistic effect to a fabric comprising or consisting of embossing and/or debossing the fabric by applying a composition comprising polyvinyl alcohol to a surface of the fabric in the shape of a design; and drying the fabric. Upon the fabric drying, the surface of the fabric to which the composition was applied is embossed and/or debossed with the design (i.e., the fabric has an emboss and/or deboss in the shape of the design). Methods of the present invention preferably exclude the use of a mold. For example, methods of the present invention preferably exclude any steps of applying heat and pressure to the fabric while pressing the fabric over a mold, or between two molds, to create an embossed or debossed effect.

A user may apply the polyvinyl alcohol composition to the fabric in the shape of any design or pattern. The term "design" is used interchangeably herein with the term "pattern." A design or pattern may comprise any type of mark made on the fabric with the composition, whether it is a dot, line, shape, figure, or any other type of design or pattern created by the user. The composition may be applied to the fabric in multiple designs, so that the fabric becomes embossed and/or debossed with each of the multiple designs. The composition comprising polyvinyl alcohol (also referred to herein as the "polyvinyl alcohol composition" or the "composition") is applied in an amount that causes the portion of fabric to which it is applied to become wet (preferably soaked through) with the composition. The amount of the polyvinyl alcohol composition applied to the fabric is effective to cause the emboss and/or deboss effect.

As used herein, an "embossed" design refers to a design or pattern that is raised with respect to the surface of the fabric to which the composition has been applied. A "debossed" design refers to a design or pattern that is depressed with respect to the surface of the fabric to which the composition has been applied. When an embossed design or pattern (alternatively referred to as an "emboss") is formed on a surface of the fabric (e.g., on an outer surface), a corresponding debossed design or pattern (alternatively referred to as a "deboss") is formed on the opposite surface (e.g., the inner surface). Similarly, when a deboss is formed on a surface of the fabric (e.g., on an outer surface), a corresponding emboss is formed on the opposite surface (e.g., the inner surface).

Figure 1A:
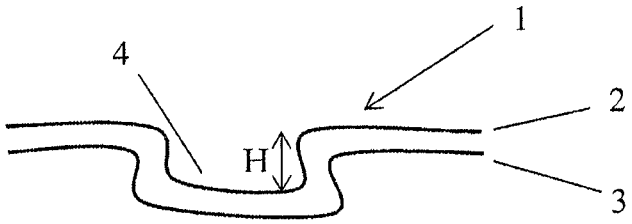
FIG. 1*a* depicts a debossed effect in fabric in accordance with an embodiment of the present invention.
Figure 1B:
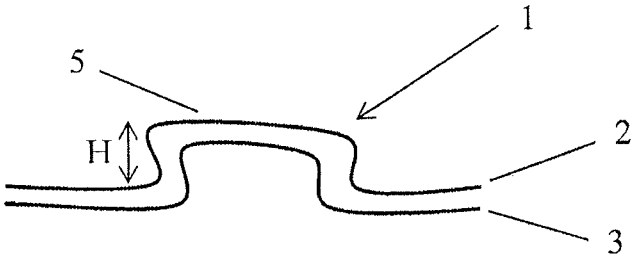
FIG. 1*b* depicts an embossed effect in fabric in accordance with an embodiment of the present invention.

Emboss and deboss effects are illustrated in FIGS. 1*a* and 1*b*, which show a side view of a fabric 1 that has an outer surface 2 and an inner surface 3. In both figures, a composition comprising polyvinyl alcohol has been applied to the outer surface 2 of the fabric 1 in accordance with embodiments of the present invention. In FIG. 1*a*, the application of the composition has caused a debossed effect in the fabric (i.e., there is a depression 4 in the fabric with respect to the surface 2 of the fabric to which the composition has been applied). In FIG. 1*b*, the application of the composition has caused an embossed effect in the fabric (i.e., there is a raised projection 5 in the fabric with respect to the surface 2 of the fabric to which the composition has been applied).

An entire design may be embossed in the fabric, or the entire design may be debossed in the fabric. Alternatively, at least some portion of a design may be embossed in the fabric, while at least another portion of the same design is debossed in the fabric. Without being bound to any theory, it is believed that whether a fabric becomes entirely embossed, entirely debossed, or partially embossed and partially debossed with a design depends, in part, on the direction in which the composition is applied with respect to the weave of the fabric. The applicants have discovered that, according to some embodiments (e.g., for 100% cotton fabric), the weave pattern of the fabric has an effect on whether the surface of the fabric to which the composition is applied becomes embossed or debossed. For example, some 100% cotton fabrics (e.g., t-shirts) have an outer surface with a weave that has a readily apparent "grain" where the warp threads appear to run from top to bottom and are prominent. The inner surface of the fabric has a weave with no predominant grain and appears to have a checkerboard pattern. When the composition is applied to the outside surface of the fabric parallel to the grain (i.e., with the grain, from top to bottom or bottom to top), the resulting effect after drying is a deboss (i.e., a depression in the outer surface of the fabric where the composition was applied). However, then the solution is applied perpendicular to the grain (i.e., against the grain, from left to right or right to left) and allowed to dry, an emboss is observed (i.e., a raised effect in the outer surface of the fabric where the composition was applied). Applying the solution in a zig-zag or sinusoidal pattern results in alternating sections of embosses and debosses. As used herein, as fabric that is "embossed and/or debossed" with a design encompasses any of these possible effects (i.e., the design is either entirely embossed in the fabric, the design is entirely debossed in the fabric, or some portion(s) of the design are embossed in the fabric and some portion(s) of the design are embossed in the fabric).

There is typically no noticeable embossing or debossing effect on the fabric while the fabric is still wet with the polyvinyl alcohol composition. However, upon the fabric drying, the embossed or debossed effect is readily apparent. The step of drying the fabric may not require any additional action on the part of the user, i.e., the step of drying the fabric may comprise allowing the fabric to air dry. For example, the composition may be allowed to air dry at room temperature overnight. Alternatively, the step of drying the fabric may comprise applying heat to the fabric (e.g., by a blow dryer or by placing the fabric in a clothes dryer).

The polyvinyl alcohol composition may be applied to the fabric according to any known method. For example, any type of applicator device may be used to apply the composition to the fabric. According to particular embodiments, the applicator device may comprise a squeeze bottle, brush, marker, or spatula. A design may be made on the fabric by "free hand" (without a template), or with a template (such as a stencil) that has a pre-made design cut out of the template. The template may be placed on top of the fabric and the composition applied over the template so that the fabric becomes embossed or debossed with the cut-out design.

According to preferred embodiments, the fabric is pre-washed, i.e., prior to applying the composition to the fabric, the fabric has been washed with detergent and water, and dried. In the case of multi-layered fabrics, such as clothing items (e.g., shirts), a water-impermeable layer or sheet (e.g., a layer of freezer paper or wax paper) may be placed between the layers (e.g., inside a shirt) to prevent the applied composition from soaking through to the other layer of fabric (e.g., the opposite side of the shirt).

After the composition comprising polyvinyl alcohol has been applied to the fabric in the shape of a design, and the fabric has dried, the emboss and/or deboss may have any height above or below the surface of the fabric to which the composition was applied (e.g., as represented by the height (H) of the emboss as shown in FIG. 1*b* or the height (H) of the deboss as shown in FIG. 1*a*). The height of the emboss and/or deboss may depend, for example, on the weave pattern of the fabric. According to particular embodiments, for example, after the composition comprising polyvinyl alcohol has been applied to the fabric in the shape of a design, and the fabric has dried, the fabric may have an emboss in the shape of the design that is raised at least about 0.5 mm above the surface of the fabric to which the composition was applied. For example, as shown in FIG. 1*b*, the height (H) of the emboss may be at least about 0.5 mm. According to alternative embodiments, the emboss may be raised between about 0.5 mm to about 3 mm above the surface of the fabric to which the composition was applied (e.g., H in FIG. 1*b* is between about 0.5 mm to about 3 mm). According to other embodiments, the emboss may be raised between about 1 mm to about 2 mm above the surface of the fabric to which the composition was applied (e.g., H in FIG. 1*b* is between about 1 mm to about 2 mm). For a single embossed design, the height of some portions of the emboss may vary with respect to other portions of the emboss.

According to alternative embodiments, after the composition comprising polyvinyl alcohol has been to the fabric in the shape of a design, and the fabric has dried, the fabric may have a deboss in the shape of the design that is depressed at least about 0.5 mm below the surface of the fabric to which the composition was applied. For example, as shown in FIG. 1*a*, the height (H) of the deboss may be at least about 0.5 mm. According to alternative embodiments, the deboss may be depressed between about 0.5 mm to about 3 mm below the surface of the fabric to which the composition was applied (e.g., H in FIG. 1*a* is between about 0.5 mm to about 3 mm). According to other embodiments, the deboss may be depressed between about 1 mm to about 2 mm below the surface of the fabric to which the composition was applied (e.g., H in FIG. 1*a* is between about 1 mm to about 2 mm). For a single debossed design, the height of some portions of the deboss may vary with respect to other portions of the deboss.

According to alternative embodiments, after the polyvinyl alcohol composition has been applied to the fabric, and the fabric has dried, a user may further decorate the fabric, such as by dying the fabric with a particular color, or by tie-dying the fabric (e.g., a t-shirt) by known methods.

As used herein, "fabric" (which is interchangeable with the term "cloth") comprises or consists of strands of natural and/or synthetic fibers (e.g., yarn and/or thread) that have been woven together (such as by weaving or knitting) so that they are interlaced. "Yarn" is a continuous strand of natural and/or synthetic fibers, such as wool, nylon, flax, cotton, or other material, that is produced by spinning the fibers together. "Thread," is a type of yarn used for sewing. Stands of thread or yarn are woven or knitted together to form fabric or cloth. "Fabric" as used herein preferably excludes textiles that have one or more layers of "pile" (tufts of fiber that project upward off of a backing layer), such as carpets and rugs.

Examples of the types of yarn or thread that may be used to form the fabric described herein include, but are not limited to, cotton, nylon, polyester, rayon, silk, wool, and blends thereof. The fabric may comprise, for example, an item of clothing or an accessory, such as a shirt (e.g., a t-shirt), pair of pants, skirt, dress, sock, undergarment, hat, glove, jacket, or handbag. The fabric to which compositions of the present invention are applied may alternatively be a piece of fabric that will eventually form a portion of an item of clothing or accessory (referred to herein as a "clothing precursor" or "accessory precursor"). The fabric may alternatively be another type of article, such as a household item (e.g., a tablecloth or drapes). Examples of the types of fabric that may be used include natural fabric, synthetic fabric, or blends of natural and synthetic fabric, e.g., cotton, nylon, polyester, rayon, silk, wool, or blends thereof. Particularly preferred types of fabric used in accordance with the present invention comprise or consist of 100% cotton, polyester, or a cotton/polyester blend (e.g., 50% cotton and 50% polyester, or 60% cotton and 40% polyester). In exemplary embodiments, the fabric is t-shirt material that consists of 100% cotton knit or a blend of cotton and polyester.

In accordance with embodiments of the present invention, the composition comprising polyvinyl alcohol is applied to fabric that comprises or consists of yarn or thread that has been woven or knitted together (i.e., the composition comprising polyvinyl alcohol is applied to fabric after the fabric has been formed by weaving or knitting yarn or thread together to form the fabric). Thus, the polyvinyl alcohol composition is not applied to fibers, yarn, or thread before the fibers, yarn, and/or thread have been woven or knitted together to form the fabric; for example, the composition is not applied to fibers, yarn, or thread before or during the process of spinning the fibers to form the yarn or thread.

Polyvinyl alcohol is produced via partial or complete hydrolysis of polyvinyl acetate. The physical characteristics of polyvinyl alcohol, and its functional uses, depend, in part, on its degree of hydrolysis (i.e., the degree to which the polyvinyl acetate has been hydrolyzed). Thus, polyvinyl alcohols differ with respect to the percentage of the polyvinyl acetate that is hydrolyzed. According to particular embodiments, the composition comprising polyvinyl alcohol that is applied to the fabric comprises polyvinyl alcohol that is at least about 90% hydrolyzed (i.e., having about 10% polyvinyl acetate or less, and about 90% polyvinyl alcohol or more). More preferably, the polyvinyl alcohol is at least about 95% hydrolyzed, or at least about 98% hydrolyzed. In alternative embodiments, the polyvinyl alcohol is between about 90% to about 100% hydrolyzed, more preferably between about 95% to about 99.9% hydrolyzed, most preferably between about 98% to about 99.5% hydrolyzed (as used herein, a % hydrolysis refers to mole %).

According to particular embodiments, the composition comprising polyvinyl alcohol that is applied to fabric comprises between about 4 wt % to about 12 wt % polyvinyl alcohol in an aqueous solution. The aqueous solution preferably comprises or consists of water. For example, the polyvinyl alcohol composition may comprise between about 5 wt % to about 10 wt % polyvinyl alcohol in an aqueous solution, or between about 7 wt % to about 9 wt % polyvinyl alcohol in an aqueous solution.

According to particular embodiments, the viscosity of the composition is at least about 100 cP. For example, the viscosity of the composition may be between about 100 cP to about 750 cP. Viscosities of about 100 cP or more help maintain the integrity of the embossed or debossed design by preventing excessive wicking or absorption into the fabric, and spreading over the fabric.

The pH of the polyvinyl alcohol composition is preferably between about 5.5 to about 7.5, more preferably between about 6 and 7. Methods of the present invention preferably exclude the application of a strong acid (e.g., pH of 5 or less) or a strong base (e.g., pH of 8 or more) to the fabric. Thus, the polyvinyl alcohol composition preferably excludes strong acids and strong bases.

The composition comprising polyvinyl alcohol may further comprise one or more colorants (e.g., dyes and/or pigments), and may also further comprise one or more optional additives. Optional additives may be selected, for example, from the group consisting of pH adjusters, buffers, dispersing agents, preservatives, emulsifiers, thickening agents, anti-foam agents, and combinations thereof. In preferred embodiments, polyvinyl alcohol is the only polymeric component in the composition. The composition may comprise impurities resulting from the manufacturing process of polyvinyl alcohol, i.e., from the process of hydrolyzing polyvinyl acetate to form the polyvinyl alcohol. Examples of possible impurities include sodium acetate, methanol, and/or methyl acetate. The amount of impurities present in the composition is preferably less than about 5 wt %, more preferably less than about 4 wt %. For example, the amount of impurities present in the composition may be between 0% to about 5%, between about 0.1% to about 4%, or between about 2.5 wt % to about 3.5 wt %.

According to particular embodiments, the polyvinyl alcohol composition consists of an aqueous solution (preferably water) consisting of polyvinyl alcohol (preferably at least 90% hydrolyzed), one or more optional impurities resulting from the process of manufacturing the polyvinyl alcohol, one or more optional colorants, and one or more optional additives.

In particular embodiments, examples of suitable polyvinyl alcohol compositions include the commercially available Celvol® 08-125 and Celvol® 09-325, as set forth below:

Celvol® 08-125:

| Specifications | | Limits |
|---|---|---|
| Hydrolysis, mole % | min. | 99.30 |
| Solution Viscosity, cP | | 700.00 +/− 600.00 |
| Solution Solids, wt % | max. | 7.50 +/− 0.50 |
| Total Organic Volaties, wt % | max. | 1.00 |
| Methanol, wt % | max. | 0.90 |
| Ash - ISE, wt % | max. | 1.20 |
| Solution pH | | 6.50 +/− 1.00 |
| Appearance | record only | Clear/Hazy Liquid |

Celvol® 09-325:

| Specifications | | Limits |
|---|---|---|
| Hydrolysis, mole % | | 98.40 +/− 0.40 |
| Solution Viscosity, cP | | 750.00 +/− 550.00 |
| Solution Solids, wt % | | 8.50 +/− 0.50 |
| Total Organic Volaties, wt % | max. | 1.00 |
| Methanol, wt % | max. | 1.00 |
| Ash - ISE, wt % | max. | 1.20 |
| Solution pH | | 6.50 +/− 1.00 |
| Appearance | record only | Clear/Hazy Liquid |

The applicants have found that the emboss/deboss effect of the present invention remains stable in the fabric after one or more wash/dry cycles (i.e., after washing the fabric with detergent and subsequently drying it). For example, the fabric retains the embossed and/or debossed effect after at least five wash/dry cycles.

Another embodiment of the present invention provides a kit for use in embossing and/or debossing fabric in accordance with the methods and compositions described herein. The kit preferably comprises a composition comprising polyvinyl alcohol inside of a container; and one or more applicators. The kit may also comprise instructions for use of the composition to emboss and/or deboss fabric in accordance with embodiments of the present invention. The kit may further include one or more pieces of fabric (e.g., one or more items of clothing, such as a t-shirt). The kit may optionally include one or more dyes (e.g., tie-dyes) for further coloring the fabric. The applicator(s) may comprise a nozzle connected to the container, wherein the container is a squeeze bottle. The applicator(s) in the kit may alternatively be selected from the group consisting of squeeze bottles, brushes, markers, spatulas, and combinations thereof.

Although the present invention has been described in connection with specific embodiments, it should be understood that the invention as claimed should not be unduly limited to such specific embodiments. Indeed, various modifications and variations of the described compositions and methods of the invention will be apparent to those of ordinary skill in the art and are intended to be within the scope of the appended claims.

What is claimed is:

1. A method for embossing a fabric, comprising:

applying a composition comprising polyvinyl alcohol to a surface of the fabric in the shape of a design that is substantially perpendicular to the weave of the fabric; and drying the fabric, wherein, upon the fabric drying, the surface of the fabric is embossed in the shape of the design.

2. The method of claim 1, comprising using a squeeze bottle, brush, marker, or spatula to apply the composition to the fabric.

3. The method of claim 1, wherein the step of drying the fabric comprises allowing the fabric to air dry.

4. The method of claim 1, wherein the step of drying the fabric comprises applying heat to the fabric.

5. The method of claim 1, wherein the composition comprises polyvinyl alcohol that is at least about 90% hydrolyzed.

6. The method of claim 1, wherein the composition comprises polyvinyl alcohol that is at least about 95% hydrolyzed.

7. The method of claim 1, wherein the composition comprises polyvinyl alcohol that is at least about 98% hydrolyzed.

8. The method of claim 1, wherein the composition comprises polyvinyl alcohol that is between about 98% to about 99.5% hydrolyzed.

9. The method of claim 1, wherein the composition has a viscosity of at least about 100 cP.

10. The method of claim 1, wherein the fabric comprises cotton.

11. The method of claim 1, wherein the fabric is 100% cotton.

12. The method of claim 1, wherein the fabric comprises natural fabric, synthetic fabric, or blends of natural and synthetic fabric.

13. The method of claim 1, wherein the fabric is an item of clothing or a clothing precursor.

14. The method of claim 13, wherein the fabric is a shirt.

15. The method of claim 1, wherein the composition further comprises one or more colorants.

16. The method of claim 1, wherein the composition further comprises one or more additives.

17. The method of claim 1, wherein the fabric has an emboss in the shape of the design that is raised at least about 0.5 mm above the surface of the fabric.

18. The method of claim 1, wherein the fabric has an emboss in the shape of the design that is raised between about 1 mm to about 2 mm above the surface of the fabric.

19. The method of claim 1, comprising applying the composition to the fabric in shapes of multiple designs, wherein, upon the fabric drying, the fabric is embossed with each of the multiple designs.

20. A method for debossing a fabric, comprising:

applying a composition comprising polyvinyl alcohol to a surface of the fabric in a shape of a design that is substantially parallel to the weave of the fabric; and drying the fabric, wherein, upon the fabric drying, the surface of the fabric is debossed in the shape of the design.

21. The method of claim 20, comprising using a squeeze bottle, brush, marker, or spatula to apply the composition to the fabric.

22. The method of claim 20, wherein the step of drying the fabric comprises allowing the fabric to air dry.

23. The method of claim 20, wherein the step of drying the fabric comprises applying heat to the fabric.

24. The method of claim 20, wherein the composition comprises polyvinyl alcohol that is at least about 90% hydrolyzed.

25. The method of claim 20, wherein the composition comprises polyvinyl alcohol that is at least about 95% hydrolyzed.

26. The method of claim 20, wherein the composition comprises polyvinyl alcohol that is at least about 98% hydrolyzed.

27. The method of claim 20, wherein the composition comprises polyvinyl alcohol that is between about 98% to about 99.5% hydrolyzed.

28. The method of claim 20, wherein the composition has a viscosity of at least about 100 cP.

29. The method of claim 20, wherein the fabric comprises cotton.

30. The method of claim 20, wherein the fabric is 100% cotton.

31. The method of claim 20, wherein the fabric comprises natural fabric, synthetic fabric, or blends of natural and synthetic fabric.

32. The method of claim 20, wherein the fabric is an item of clothing or a clothing precursor.

33. The method of claim 32, wherein the fabric is a shirt.

34. The method of claim 20, wherein the composition further comprises one or more colorants.

35. The method of claim 20, wherein the composition further comprises one or more additives.

36. The method of claim 20, wherein the fabric has a deboss in the shape of the design that is depressed at least about 0.5 mm below the surface of the fabric.

37. The method of claim 20, wherein the fabric has a deboss in the shape of the design that is depressed between about 1 mm to about 2 mm below the surface of the fabric.

38. The method of claim 20, comprising applying the composition to the fabric in shapes of multiple designs, wherein, upon the fabric drying, the fabric is debossed with each of the multiple designs.

* * * * *